US007717837B2

(12) United States Patent
Florczak

(10) Patent No.: US 7,717,837 B2
(45) Date of Patent: May 18, 2010

(54) EXERCISE SYSTEM AND RELATED METHODS

(76) Inventor: Phillip Florczak, 441 E. Erie, Apt. 2506, Chicago, IL (US) 60611

( * ) Notice: Subject to any disclaimer, the term of this patent is extended or adjusted under 35 U.S.C. 154(b) by 0 days.

(21) Appl. No.: 11/879,411

(22) Filed: Jul. 17, 2007

(65) Prior Publication Data

US 2009/0023566 A1 Jan. 22, 2009

(51) Int. Cl.
*A63B 26/00* (2006.01)
*A63B 71/00* (2006.01)

(52) U.S. Cl. ..... 482/143; 482/62

(58) Field of Classification Search ..... 482/34, 482/62, 33, 142, 139, 94, 108, 134, 14–17, 482/23, 38–41, 51, 91–92, 148, 908
See application file for complete search history.

(56) References Cited

U.S. PATENT DOCUMENTS

| | | | | | |
|---|---|---|---|---|---|
| 2,817,522 | A | * | 12/1957 | Margulies | 482/145 |
| 2,932,510 | A | * | 4/1960 | Kravitz | 482/38 |
| 3,117,760 | A | * | 1/1964 | Dresbach et al. | 248/188.5 |
| 3,451,271 | A | * | 6/1969 | Knoblauch | 482/113 |
| 3,642,278 | A | | 2/1972 | Hinckley | |
| 3,896,798 | A | * | 7/1975 | Simon | 606/241 |
| 4,113,250 | A | * | 9/1978 | Davis | 482/144 |
| 4,241,914 | A | * | 12/1980 | Bushnell | 482/130 |
| 4,258,913 | A | * | 3/1981 | Brentham | 482/45 |
| 4,564,193 | A | * | 1/1986 | Stewart | 482/60 |
| D290,033 | S | | 5/1987 | Policastro | |
| 4,772,011 | A | | 9/1988 | Guridi | |
| 4,784,384 | A | * | 11/1988 | Deola | 482/99 |
| 4,789,152 | A | * | 12/1988 | Guerra | 482/142 |
| 4,923,194 | A | | 5/1990 | Montgomery | |
| 5,096,187 | A | * | 3/1992 | Marples | 482/41 |
| 5,141,480 | A | * | 8/1992 | Lennox et al. | 482/104 |
| 5,156,580 | A | * | 10/1992 | Holland et al. | 482/39 |
| 5,277,676 | A | * | 1/1994 | Holland et al. | 482/39 |
| 5,346,448 | A | * | 9/1994 | Sollo | 482/104 |
| 5,527,242 | A | * | 6/1996 | Gangloff | 482/38 |
| 5,536,222 | A | | 7/1996 | Banda et al. | |
| 5,669,859 | A | * | 9/1997 | Liggett et al. | 482/94 |
| 5,989,158 | A | | 11/1999 | Fredette | |
| 6,149,556 | A | * | 11/2000 | Jordan | 482/104 |
| 6,217,483 | B1 | * | 4/2001 | Kallassy | 482/38 |
| 6,254,517 | B1 | * | 7/2001 | Kennedy | 482/121 |
| 6,264,586 | B1 | * | 7/2001 | Webber | 482/104 |
| 6,270,448 | B1 | * | 8/2001 | Smith | 482/148 |
| 6,283,898 | B1 | * | 9/2001 | Polidi | 482/104 |
| 6,409,640 | B2 | * | 6/2002 | Cournoyer | 482/141 |
| 7,025,710 | B2 | * | 4/2006 | Corbalis et al. | 482/52 |
| 7,104,938 | B1 | * | 9/2006 | Smith | 482/142 |
| 7,125,371 | B2 | * | 10/2006 | Henderson | 482/142 |
| 7,156,788 | B1 | * | 1/2007 | Jackson et al. | 482/141 |
| 7,226,400 | B1 | * | 6/2007 | Gedeon-Janvier | 482/104 |
| 7,229,392 | B2 | * | 6/2007 | Turnbull et al. | 482/129 |

(Continued)

*Primary Examiner*—Lori Baker
(74) *Attorney, Agent, or Firm*—Valauskas & Pine LLC

(57) ABSTRACT

Facilitating exercise using easy to transport and easy to assemble components and, when assembled, providing a portable apparatus on which a human can engage in a wide variety of exercises. Support elements including vertical components are supported on bases. Collars slideably insert over the support elements and further include bar supports for receiving one or more stabilizers. The stabilizers join the support elements and the bases forming a system base.

17 Claims, 9 Drawing Sheets

U.S. PATENT DOCUMENTS

| | | | | |
|---|---|---|---|---|
| 7,278,959 | B2 * | 10/2007 | Brown, III | 482/104 |
| 2003/0134722 | A1 * | 7/2003 | Greenland | 482/100 |
| 2004/0157711 | A1 * | 8/2004 | Regev | 482/142 |
| 2004/0192522 | A1 * | 9/2004 | Hippensteel | 482/142 |
| 2004/0204292 | A1 * | 10/2004 | Chu | 482/41 |
| 2005/0003938 | A1 * | 1/2005 | Henderson | 482/143 |
| 2005/0143235 | A1 * | 6/2005 | Park | 482/142 |
| 2006/0003877 | A1 * | 1/2006 | Harmon | 482/142 |
| 2006/0040799 | A1 * | 2/2006 | Pompile | 482/92 |
| 2006/0100075 | A1 * | 5/2006 | Harsh | 482/142 |
| 2006/0183607 | A1 * | 8/2006 | Collias | 482/94 |
| 2007/0203002 | A1 * | 8/2007 | Webber | 482/104 |

* cited by examiner

EXERCISE SYSTEM AND RELATED METHODS

FIELD OF THE INVENTION

The present invention generally relates to a system and methods for facilitating exercise. More specifically, the present invention is directed to a system, certain embodiments of which include easy to transport and to assemble components and, when assembled, provide a portable apparatus on which a human can engage in a wide variety of exercises.

BACKGROUND OF THE INVENTION

There are many forms of exercises that humans use to maintain and improve their health. Some of such exercises are categorized as "aerobic" exercises, while others are considered to be "anaerobic" exercises. One group of primarily anaerobic exercises that are intended to develop and maintain strength and size of skeletal muscles are generally known as strength training. One form of strength training uses gravity to produce the desired effects. Typically, strength training involves lifting and lowering a given weight a number of times, each cycle of which is called a repetition, or "rep". A "set" is a series of reps. The type of exercise that is being repeated, the tempo at which the reps are performed, the number of reps and sets that are actually performed, and whether the person attempting the given exercise maintains proper form throughout the exercise (and doesn't "cheat", that is, use muscles other than the intended muscles to accomplish the exercise) are all important factors in determining whether and how quickly the objectives of the exercise regime are accomplished.

There are many known devices that are used by humans for exercising. A wide range of these devices include more complicated components that are professionally built in advance, then installed in the device but which, despite the complexity, often only provide a generally limited workout. With many of these more complex devices, the person using the machine must come into contact with belts or wheels or other movable features to conduct the subject exercises.

Other known devices are formed by the joining and adjustment of a multiple of components together before the person can begin exercising. Certain of these devices are not stand alone devices and, for example, must be fixed to floors, ceilings, or other parts of buildings before they can be used. Other of such devices rely on large fixed bases or platforms to provide the stability needed so that people can actually engage in exercises on the devices.

There are a variety of disadvantages associated with these known devices. The devices that utilize complex components, such as movable wheels or belts or computer-like elements must be maintained and, after breakage, must be repaired to have any usefulness. The certain known devices formed by the joining and adjustment of a multiple of components may be time consuming to assemble and require tools to complete the assembly. When disassembled, these multi-component devices require time and effort and a storage place to keep the components sufficiently organized and accessible so that the device can be set up again. The devices that must be fixed to various parts of buildings—such as ceilings, floors, and door jambs—often cannot be easily set up and taken down on as needed. The set up (and take down) may require one or more tools, some experience in using the tools, be time consuming, and ultimately cause disfigurement or damage to those parts of the buildings to which the devices are fixed. The fixing of the exercise device to a part of the building renders that part of the building to be largely unusable for any purpose other than the use of the device for exercising. Known devices with large fixed base structures or platforms may be costly to transport—because of the packaging needed for the device, and the possible relatively greater weight associated with such devices also may be difficult for a single person to move from shipment drop off point to the point where the device is going to be set up and used and be inconvenient to move once set up. Many known devices with large bases, while possibly more stable, may permit only a limited range of exercises to be conducted thereon because the base may block more complete access to the exercise device including by those in a wheelchair.

A demand therefore exists for a system and methods, embodiments of the apparatus of which are formed from light weight, easy to transport components that can be quickly joined together without the need for tools and, when fully assembled, provide a stable platform on which a wide variety of exercises can be performed. The present invention satisfies the demand.

SUMMARY OF THE INVENTION

The present invention is directed to an exercise system, certain embodiments of which may be easily assembled from light weight and easy to transport components and, when assembled, provides a stable platform on which a wide variety of exercises may be performed.

For purposes of this application, the person using the exercise system will be termed "exerciser" herein. Also, for purposes of this application, the surface on which the exercise system is placed will be termed "floor" even though the system can be used and the methods conducted in a wide variety of interior spaces—including buildings—and exterior spaces—including a lawn area or a garden area, a playground, a patio, driveway, or other hard surface—and even in and on non-fixed structures—such as a boat and on its deck or other area of the vessel.

The exercise system of the present invention is directed to an apparatus that includes at least two support elements supportable on a system base. Certain preferred embodiments of the system include two support elements that can be further joined by one or more stabilizers. The support elements as joined are each supported on a base that collectively form the system base. In one preferred embodiment, each of the two support elements includes a base and a vertical component. Certain preferred embodiments of the vertical components include a post support on which a vertical post is received—thereby providing support therefor—and a post extension in slidable engagement with the vertical post.

While the base of each support element may be of any size and configuration to provide stable support for the vertical component, and thereby the system, one preferred embodiment of the exercise system includes support elements each with a base. Each base includes a first base section to which the vertical component is attachable or attached. The first base section of this embodiment includes opposing ends onto each of which a stabilizing rest is attached.

In one preferred embodiment, each support element includes a support base component having a reception element in which at least a portion of the vertical component may be releasably received thereby providing stable support therefore. One embodiment of the reception element is a flush reception aperture generally not raised above and opens through the first base section and is sized and shaped to receive a portion of the post support. Another embodiment of the reception element includes a raised reception element in or on which the post support may be received. The raised reception element may be fixed to and extend above the top surface of the first base section.

The vertical post includes a post inner space into which at least an extension insertion portion of the post extension is receivable. An embodiment of the post extension is sized and shaped and includes an extension outer surface such that at least a portion of the post extension is receivable within the post inner space.

Certain preferred embodiments of the support element include locking elements by which the relationship of one component of the support element relative to another may be easily established and maintained without the need for tools. One preferred embodiment of the locking element includes locking apertures and one or more locking pin.

In order to facilitate a number of exercises to be conducted thereon, an embodiment of the system includes one or more collars. One preferred embodiment of a collar is a handle collar. An embodiment of the handle collar includes a collar outer surface—to which one or more exercise handles may be fixed—and a collar inner surface—having a size and shape such that the collar may be inserted over and on a collar end of the post extension. An additional embodiment of a collar—and on an extension collar—is sized and shaped such that the extension collar may be slid along the post surface of the post extension. Embodiments of the collar may include one or more locking apertures that are sized and shaped and spaced along and through the collar outer surface such that a locking pin may be inserted therethrough in order to fix the position of the collar relative to other components of the support element.

Embodiments of the support element preferably include components to accept a stabilizer by which the position of each support element relative to the other support element, and thereby the entire exercise system is releasably fixed in a stable desired position. Embodiments of the exercise system can include one or more of the stabilizers.

One embodiment of the stabilizer of the present system includes an upper stabilizer. An embodiment of the upper stabilizer includes an upper stabilizer bar and upper bar supports. In one embodiment, the upper stabilizer bar is shaped as an elongated rod having opposing ends, each of which is receivable in an upper bar support forming an element of the opposing support element thereby providing support for the stabilizer bar and stably joining the support elements into the exercise system. In one preferred embodiment, each upper bar support is fixed to a surface of the handle collar. Such a system—in which a stabilizer bar is carried between the two support elements not only acts to improve the stability of the entire exercise system, but also allows an exerciser to do, for example, exercises—such as pull ups—that do not require additional exercise appliances and exercises that do require such appliances such as gravity boots, rings, etc.

Another embodiment of the stabilizer of the present invention includes a lower stabilizer. An embodiment of the lower stabilizer includes a lower stabilizer bar and lower bar supports. In one embodiment, the lower stabilizer bar is shaped as an elongated rod having opposing ends each of which is receivable in a lower bar support that forms an element of the support element. As with the upper stabilizer bar, the lower stabilizer bar may be in other shapes and have other structures associated therewith. Each of the lower bar supports may be fixed to a surface of the lower handle collar. Each of the lower bar supports may be fixed also to an outer surface of each support system such as the outer surface of the vertical post. An exercise system that includes such a lower stabilizer bar can improve the stability of the entire exercise system while permitting a person to conduct some additional exercises. For example, the person could do push ups on the lower exercise bar such that the person's body is raised above and at an angle relative to the floor on which the exercise system rests. The lower exercise bar can also permit—if placed in a position relatively closer to the floor—the exerciser to engage the bar with the exerciser's feet and perform sit ups without the need for another person to hold the exerciser's feet in place so that they do not rise with each rep.

An additional embodiment of the exercise system of the present invention may include a base stabilizer. An embodiment of the base stabilizer includes a base bar that is sized and shaped to engage at least a portion of each base component. One preferred embodiment of the present invention includes a base bar that is sized and shaped and includes at least one base bar end that is receivable within the base receiving portion of the base component. With each support element positioned generally side by side to each other, and the base components of the support base positioned generally adjacent to each other, the bar ends of the base bar may be received in opposing base receiving portions of the base components, thereby releasably uniting and stabilizing the separate support elements.

The components from which the system of the present invention are preferably made from materials that are of sufficient strength to permit an adult to conduct a wide range of exercises thereon without damaging the components of the system. The components may, for example, be made of steel, either painted, brushed, coated, or stainless. It is preferred that the materials from which the system components are made are relatively easy to clean after use and resistant to rusting even when used in outdoor locations.

The components from which the system of the present invention are preferably made are structured to resist unanticipated deflection or torquing. For example, many components of the system are made from a tubular shaped material having a non-circular cross section. Such shaped components resist spinning or twisting when weight is placed thereon.

One advantage of the present invention is that the system may be assembled from components that are sized and shaped such that they are easy to package and easy to transport.

Another advantage of the present invention is that components are sized and shaped and structured so that they can be joined to form desired configurations of the system without the need for tools and by one person.

A further advantage of the present invention is that certain embodiments of the system are configurable to permit a wide range of exercises to be conducted with it.

An added advantage of the present invention is that the components of the system can be assembled to provide a relatively open configuration so that those in wheel chairs may gain access to the system and conduct exercises with it.

Another advantage of the present invention is that the system is of a simplified design that does not require the use of moving belts, wheels, or weights in order to conduct exercises with the system.

An added advantage of the present invention is that the system is generally expandable in that the relatively simplified design of the system permits a wide range of exercise appliances to be attached to the components of the system.

An added advantage of the present invention is that the system can be easily disassembled and stored in a relatively small space when not in use.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will be described in conjunction with the appended drawings provided to illustrate and not to the limit the invention, where like designations denoted like elements, and in which.

DESCRIPTION OF PREFERRED EMBODIMENTS

Figure 1:
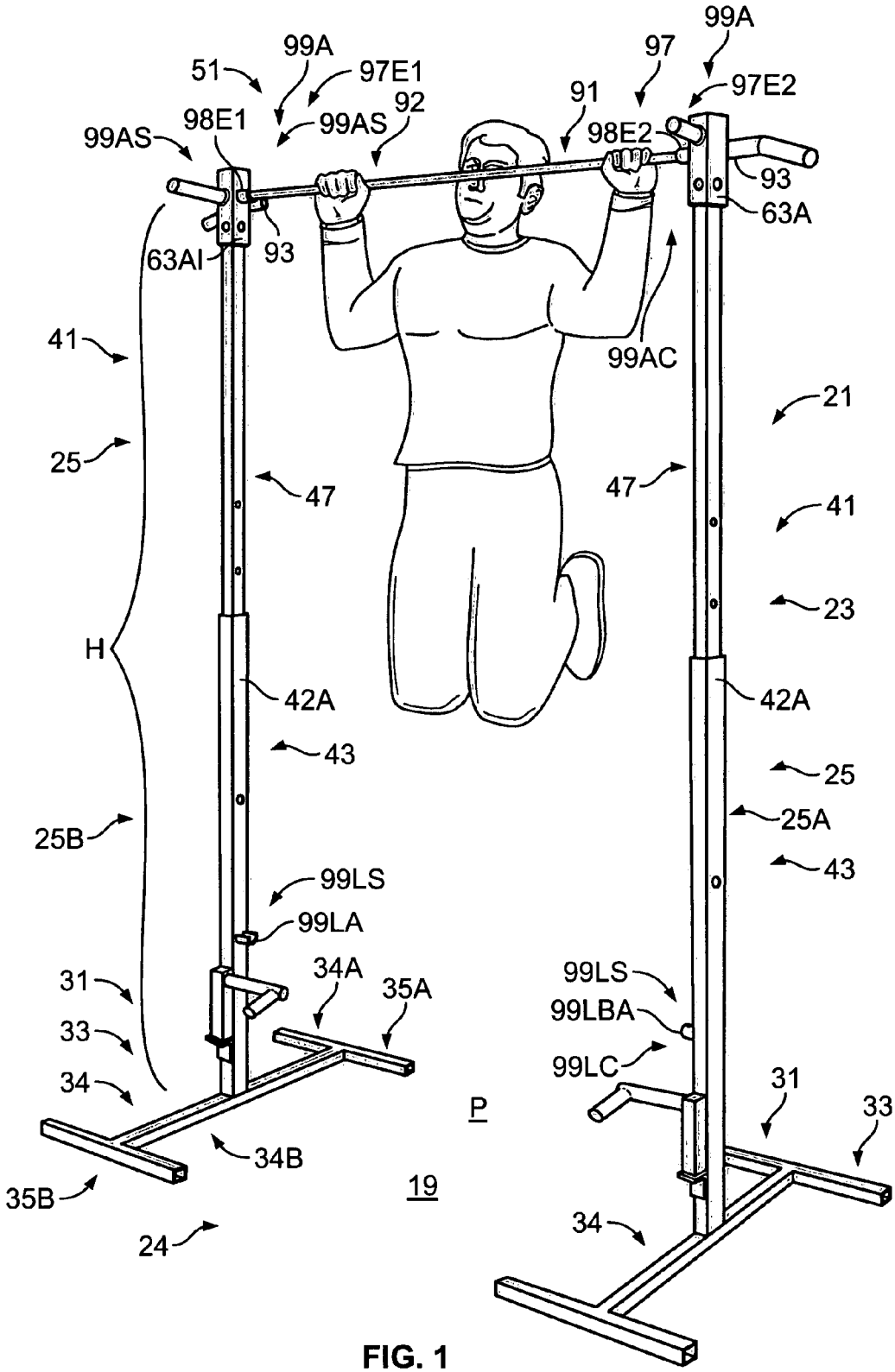
FIG. 1 is a perspective view of one embodiment of an exercise system according to the present invention shown in use and with an upper stabilizer.

A system for facilitating exercises is identified in the accompanying drawings as 21. The system 21 includes an apparatus 23 having a system base 24. Preferred embodiments of the apparatus 23 include at least two support elements 25 each having a base 31 and that can be joined by a stabilizer 91. For convenience of description, terms such as "upper", "lower", "outer", "inner", "horizontal", "vertical" "outwardly", and "inwardly" are used to refer to the apparatus 23 and the components of the apparatus 23 in a generally orthogonal orientation as illustrated in the accompanying drawings. However, it will be understood that the embodiments of the invention described in this application advantageously can be used in a variety of orientations that are not necessarily strictly orthogonal.

Figure 2:
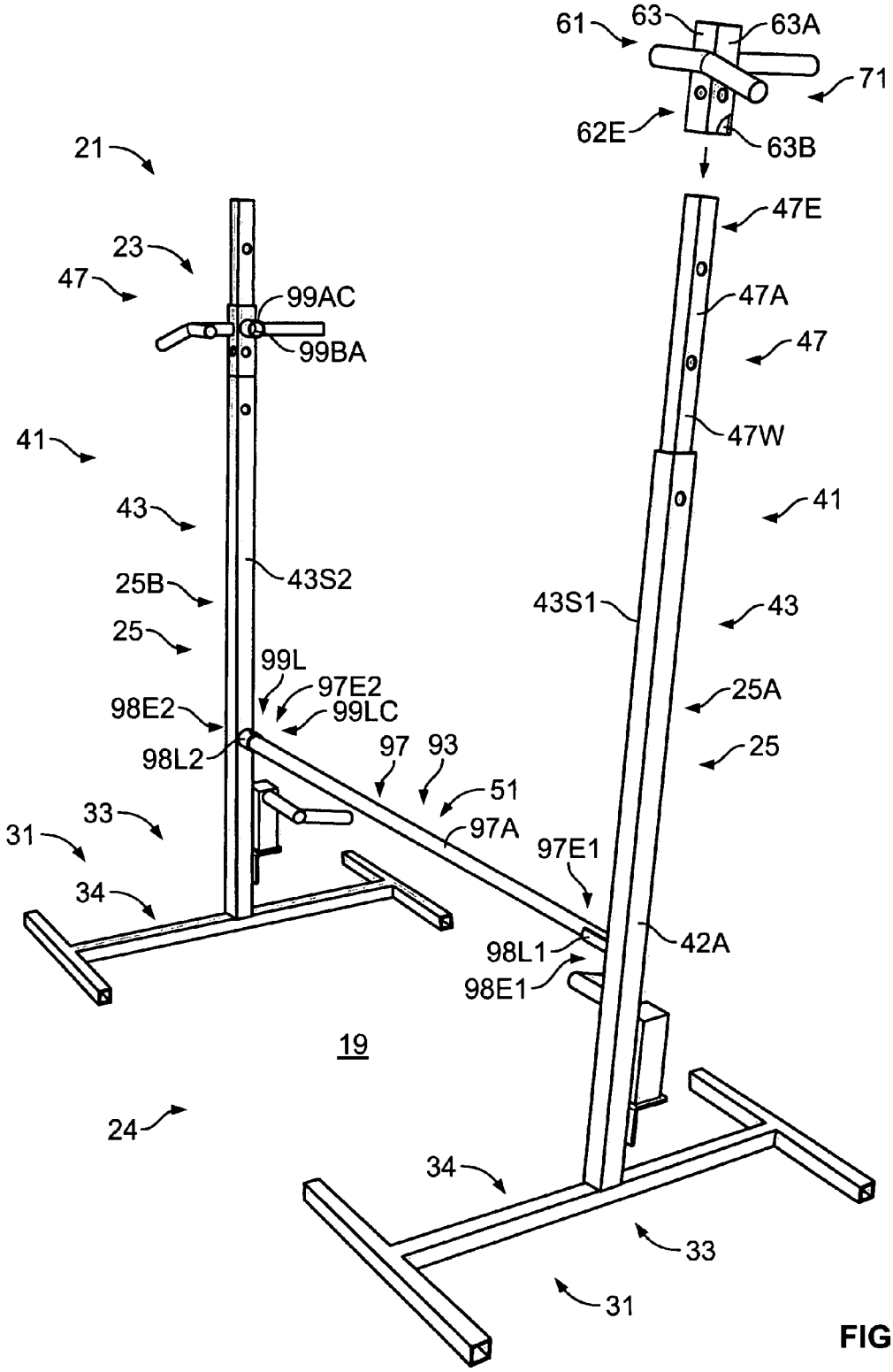
FIG. 2 is a partially exploded perspective view of another embodiment of an exercise system according to the present invention with a lower stabilizer.

One preferred embodiment of the present invention includes an apparatus 23 having two support elements 25. While each of the two support elements 25 may include some differences, FIG. 1 and FIG. 2 illustrate embodiments of the apparatus 23 having support elements 25 with generally many of the same components and features including a base 31 and a vertical component 41. With respect to an embodiment of the present invention including two support elements 25, each of the support elements may be identified in this application as a first support element 25A and a second support element 25B. For convenience, the component of each of the first support element 25A and the second support 25B may be referenced with the use of the term "first" or "second" respectively. Certain preferred embodiments of the vertical component 41 include a post support 42 onto which a vertical post 43 is positionable and a post extension 47 which is in slidable engagement with the vertical post 43 to allow the vertical dimension of the vertical component 41 to be generally adjustable.

The base 31 of each support element 25 may be of any size and configuration to provide stable support for the vertical component 41, and thereby the apparatus 23 and system 21. For example, the system base 24 or each base 31 may be of a generally planar construction. However, other embodiments may be of a more reduced construction in which the elements from which the base 31 is formed are of a more minimal construction, thereby reducing the transportation and storage costs, and, because of the reduced weight, allowing the assembly and disassembly to be accomplished quickly and easily.

Figure 3A:
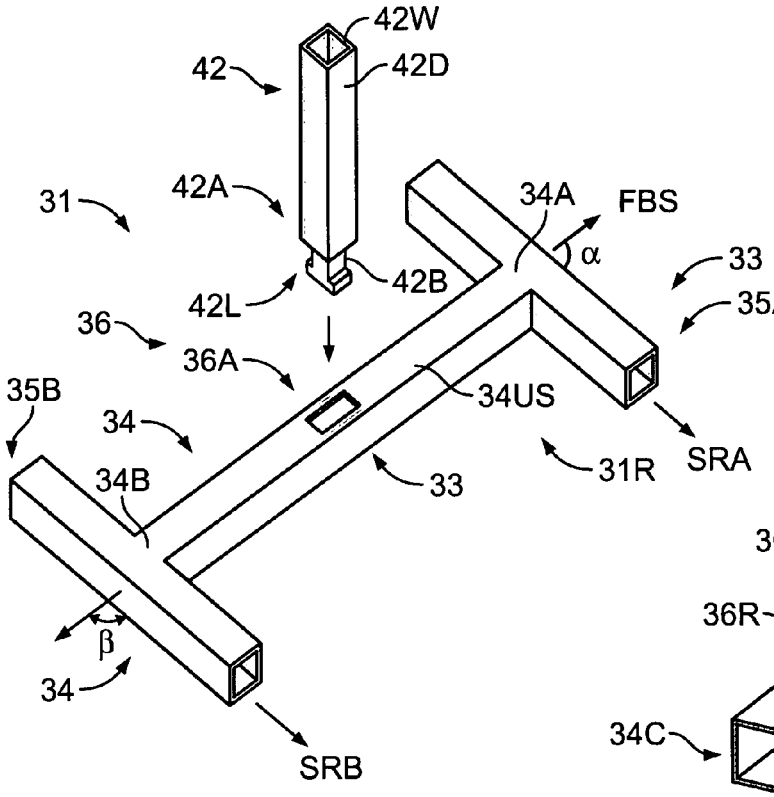
FIG. 3A is a partially exploded perspective view of the base and post support of another embodiment of the exercise system according to the present invention.
Figure 3B:
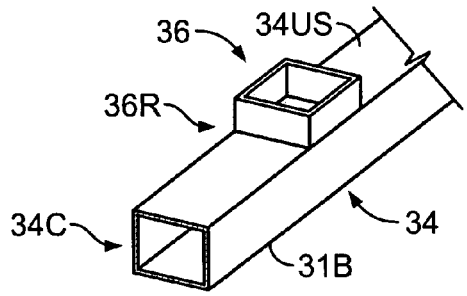
FIG. 3B is a partially cutaway perspective view of an additional embodiment of the present invention showing the base and post support.
Figure 3C:
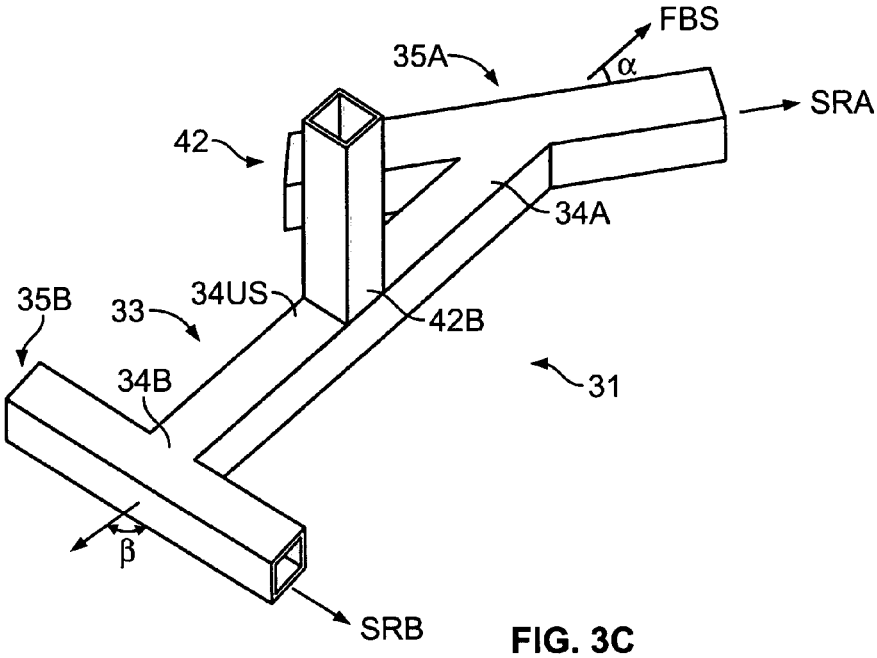
FIG. 3C is a perspective view of the post support of an additional embodiment of the exercise system having a different embodiment of a base according to the present invention.

One preferred embodiment of the support element 25 having such a more reduced construction includes a base 31 having support base components 33. The support base components 33 of the illustrated embodiments include a first base section 34 aligned along an axis "FBS" and to which the vertical post 43 of the vertical component 41 is attachable. FIG. 3A illustrates an embodiment of the first base section 34 that includes opposing ends 34A and 34B onto each of which a stabilizing rest 35A and 35B, respectively, is attached. In the illustrated embodiment, each stabilizing rest 35A, 35B is aligned along an axis, axis "SRA" for rest 35A and axis "SRB" for rest 35B, respectively, and each axis SRA, SRB is in the embodiment of the base 31 shown in FIG. 3A generally perpendicular to the axis FBS. However, one or more of the axes SRA, SRB may be positioned such that the angle "$\alpha$" formed by the axis FBS and axis SRA and the angle "$\beta$" formed by the axis FBS and axis of SRB each is less than 90 degrees or more than 90 degrees. For example, so that the floor area 19 under the apparatus 23 when fully assembled and ready for use has a more open configuration, the rest 35A for each of adjoining support elements 25 may be placed at an angle "$\alpha$" less than 90 degrees thereby defining a more open floor area 19 around the apparatus 23 into which a wheel chair move generally unimpeded. FIG. 3C illustrates an embodiment of the support base components 33 having such a more open configuration stabilizing rest 35A.

In one preferred embodiment of the present invention, each support element 25 of the apparatus 23 includes support base components 33 having a reception element 36 in which at least a portion of a post support 42 of the vertical component 41 may be releasably received thereby providing stable support therefor. One embodiment of the reception element 36 shown in FIG. 3A is a flush reception aperture 36A that is generally not raised above and opens through at least the first base section upper surface 34US of the first base section 34 and is sized and shaped to receive the post support engagement element 42A or the vertical post 43 itself. The embodiment shown in FIG. 3A includes a post support engagement element 42A having an engagement lip 42L that can be inserted through the flush reception aperture 36A and twisted to releasably lock the post support 42 to the first base section 34 and thereby the base 31. Embodiments of such support element 25 preferably include a reception aperture 36 that is sized slightly smaller than the outer dimensions of the post support 42 formed by the outer surface 42D of the post support wall 42W so that at least a base end 42B of the post support wall 42W can rest on the first base section upper surface 34US.

Other embodiments of the reception aperture 36 may include a raised reception element 36R that places the reception aperture 36 at a position not flush with but above the first base section upper surface 34US. Such an embodiment is shown in FIG. 3B.

Additional embodiments of the support element 25 includes support base components 33—not having a reception aperture 36 in which at least a portion of a post support 42 of the vertical component 41 may be releasably received—but instead in which the base end 42B of the post support 42 is fixed to the first base section upper surface 34US such as by welding or other conventional attachment means, to provide stable support for the support element 25. Such an embodiment with a post support 42 fixed to the base 31 is shown in FIG. 3C.

One or more of the elements from the base 31 is formed may be of a generally solid material or a hollowed thick walled material. A preferred embodiment of the base 31 includes at least some components having a tubular construction. Such a construction is lighter in weight than components made from a solid material.

While the base 31 may be formed from components having a variety of different shapes, the illustrated embodiments of the base 31 have a non-circular cross section 34C with a generally flat base surface 31B (see FIG. 3B), thereby providing a stable platform on which the base component 31, and thereby the entire support element 25 may rest. A base 31 having a non-circular cross section 34C advantageously permits other elements that have a similar shape to be engaged within the base 31 and retained in place even when twisting or torquing forces are applied thereto.

One embodiment of the vertical post 43 includes a wall 43W having an outer surface 44A and an inner surface 44B. The inner surface 44B defines a post inner space 45 that is sized and shaped so that the vertical post 43 may be positioned over the post support 42 so that the post support outer surface 42D is in general contact with the inner surface 44B of the vertical post 43. Such contact provides support and prevents a rocking motion within the vertical component 41 when the apparatus 23 is in use.

Embodiments of the vertical component 41 preferably include a post extension 47 sized and shaped so that extension 47 may be in slidable engagement with the vertical post 43 to allow the vertical dimension of the vertical component 41, and thereby each support element 25 and the entire apparatus 23 to be generally adjustable. The embodiment of the support element 25 shown in FIG. 4 includes a vertical post 43 having a wall 43W, the inner surface 44B of which defines a post inner space 45 that is sized and shaped to accommodate also the outer surface 47A of the post extension 47 so that at least a portion of the extension 47 may be inserted in and be slid in and out of the vertical post 43 as needed in order to adjust the overall height "H" of the vertical component 41. It is preferred that the sliding engagement of the extension 47 with the vertical post 43 is generally close also to minimize unanticipated movement of the extension 47 relative to the vertical post 43, and thereby the vertical component 41, and the entire support element 25 when the extension 47 is releasably locked in place (as explained below) and the apparatus 23 is in use.

Embodiments of the support element 25 preferably include locking elements 51 by which the desired relationship of certain of the components of the support element 25 relative to others may be easily established and maintained without the need for tools. One embodiment of the locking elements 51 is shown, for example, in FIG. 4 and includes locking apertures 53 placed along and through the walls of certain components of the support element 25 and sized and shaped such that an appropriately sized and shaped locking pin 55 may be inserted therethrough. The number and position of the locking apertures 53 may vary in different embodiments of the support element 25. Additional locking pins 55 may be provided to releasably fix different components of the support element 25 at the same time, thereby improving the stability of the system 21. More specifically, the embodiment of the support element 25 shown in FIG. 4 includes locking apertures 55 extending through the wall 43W of vertical post 43, through the wall 47W of the post extension 47, and through the wall 42W of the post support 42. Preferably, the locking apertures 53 are sized and shaped and spaced at least along the vertical post 43 and the post extension 47 such that a locking pin 55 may be inserted through the apertures, when properly aligned, in order to releasably fix the position of the post extension 47 relative to the vertical post 43.

In order to facilitate a number of exercises to be conducted on the apparatus 23, certain preferred embodiments of the system 21 include one or more collars 61. One preferred embodiment of a collar 61—a handle collar 62 includes a wall 63 having a collar outer surface 63A—to which at least one or more exercise handles 71 may be fixed—and a collar inner surface 63B having a size and shape such that the handle collar 62 may be inserted over at least a post extension upper end 47E.

Figure 4:
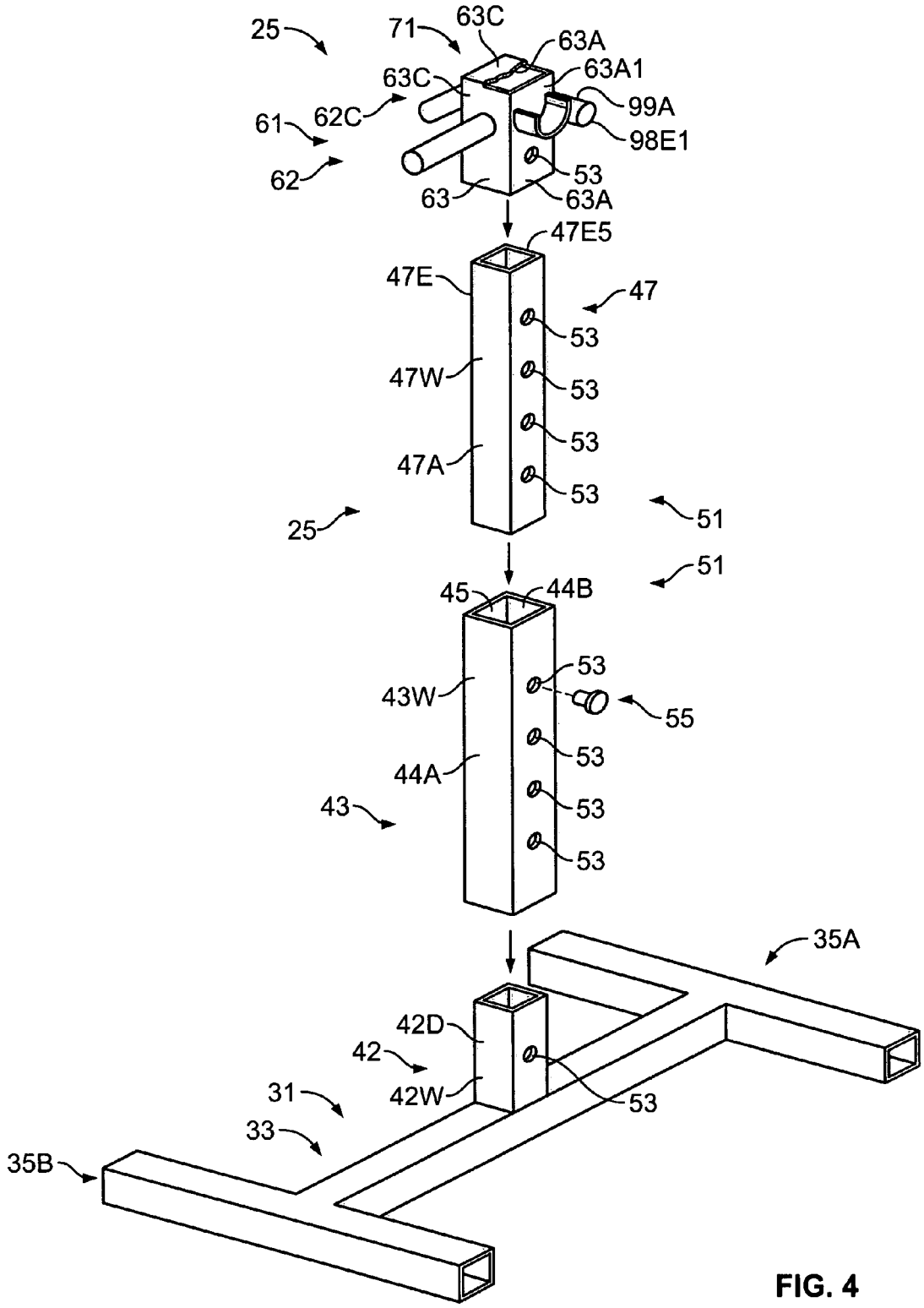
FIG. 4 is a partially exploded perspective view of another embodiment of the exercise system according to the present invention.

An embodiment of the handle collar 62 is shown in FIG. 4 and is designated "62C". The wall 63 of handle collar 62C shown in FIG. 4 includes a cap 63C such that, when the handle collar 62C is placed over the post extension upper end 47E, the inner surface 63A of the handle collar wall 63 under the cap 63C can come to rest on and thereby be supported on the extension upper end surface 47ES of the extension 47.

Another embodiment of a collar 61 is shown in FIG. 2 and is termed extension collar "62E". Extension collar 62E includes a wall 63 but without the cap 63C as does the embodiment of the handle collar 62C shown in FIG. 4. The embodiment of the extension collar 62E shown in FIG. 2 includes a wall 63 having a collar outer surface 63A—to which at least one or more exercise handles 71 may be fixed—and a collar inner surface 63B having a size and shape such that the extension collar 62E may be inserted over the post extension upper end 47E and slid down and along the outer surface 47A of the post extension 47 so that the extension collar 62E may be placed at generally any desired location along the extension 47 and thereby in order to adjust the position of the exercise handles 71 that may be mounted on the extension collar 62E to accommodate a wide variety exercises. It is preferred that the inner surface 63B of the extension collar 62E is shaped and sized so that the extension collar 62E makes generally smooth engagement with the outer surface 47 of the post extension 47 so as to also minimize unanticipated movement of the extension collar 62E relative to the post extension 47, and thereby the vertical component 41 when the extension 47 is releasably locked in place (as explained below) and the apparatus 23 is in use.

As with the post support 42, the vertical post 43, and the post extension 47, the collars 61 may include one or more locking apertures 53 that are sized and shaped and spaced along and through the handle collar wall 63A such that a locking pin 55 may be inserted therethrough and through the post extension wall 47W in order to fix the position of the handle collar 62E relative to the post extension 47 and thereby the vertical component 42.

An additional embodiment of the collar 61 includes one that is sized and shaped to be positionable lower on each support element 25 and is termed "lower collar" and designated "62L". One or more exercise handles 71 may extend from and be carried on the outer surface 63A of lower collar 62L. The inner surface 63B of the lower collar 62L is sized and shaped such that the lower collar 62L may be moved over the outer surface 44A of the vertical post 43. The handle collar 62L may include one or more locking apertures 53 that are sized and shaped and spaced along and through the handle collar wall 62W such that a locking pin 55 may be inserted therethrough and through the post extension wall 43W in order to fix the position of the handle 71.

Figure 5A:
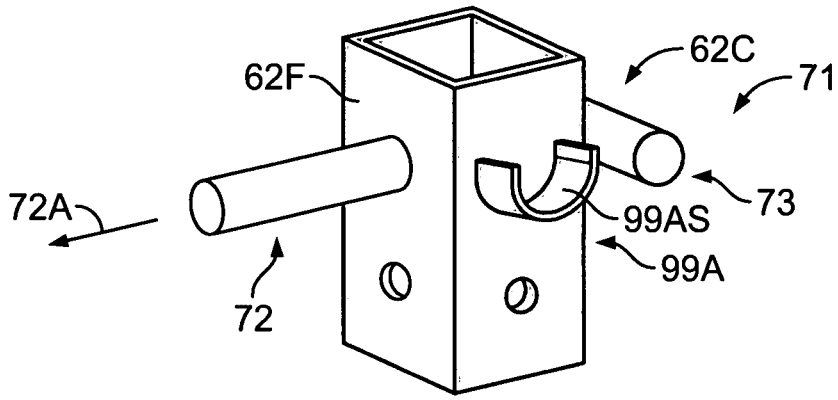
FIG. 5A is a perspective view of an embodiment of the handle collar component of the present invention.
Figure 5B:
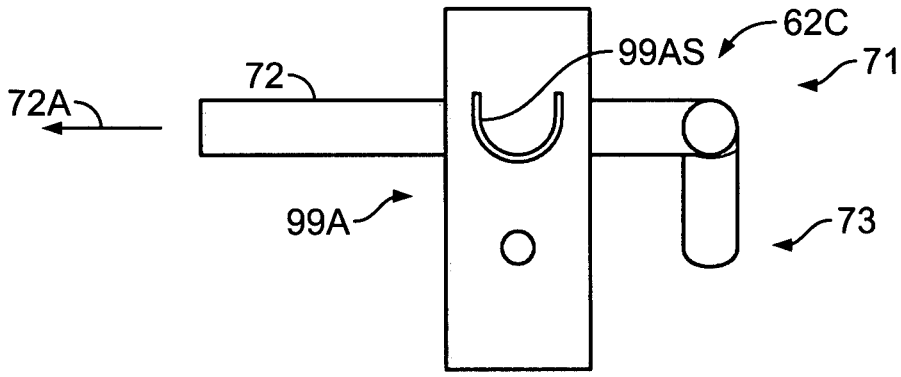
FIG. 5B is a side view of the embodiment of the handle collar shown in FIG. 5A.
Figure 5C:
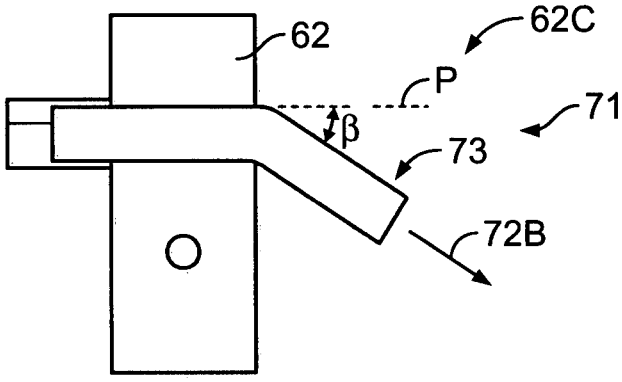
FIG. 5C is a view of the handle collar shown in FIG. 5A but from the opposing side shown in FIG. 5B.
Figure 5D:
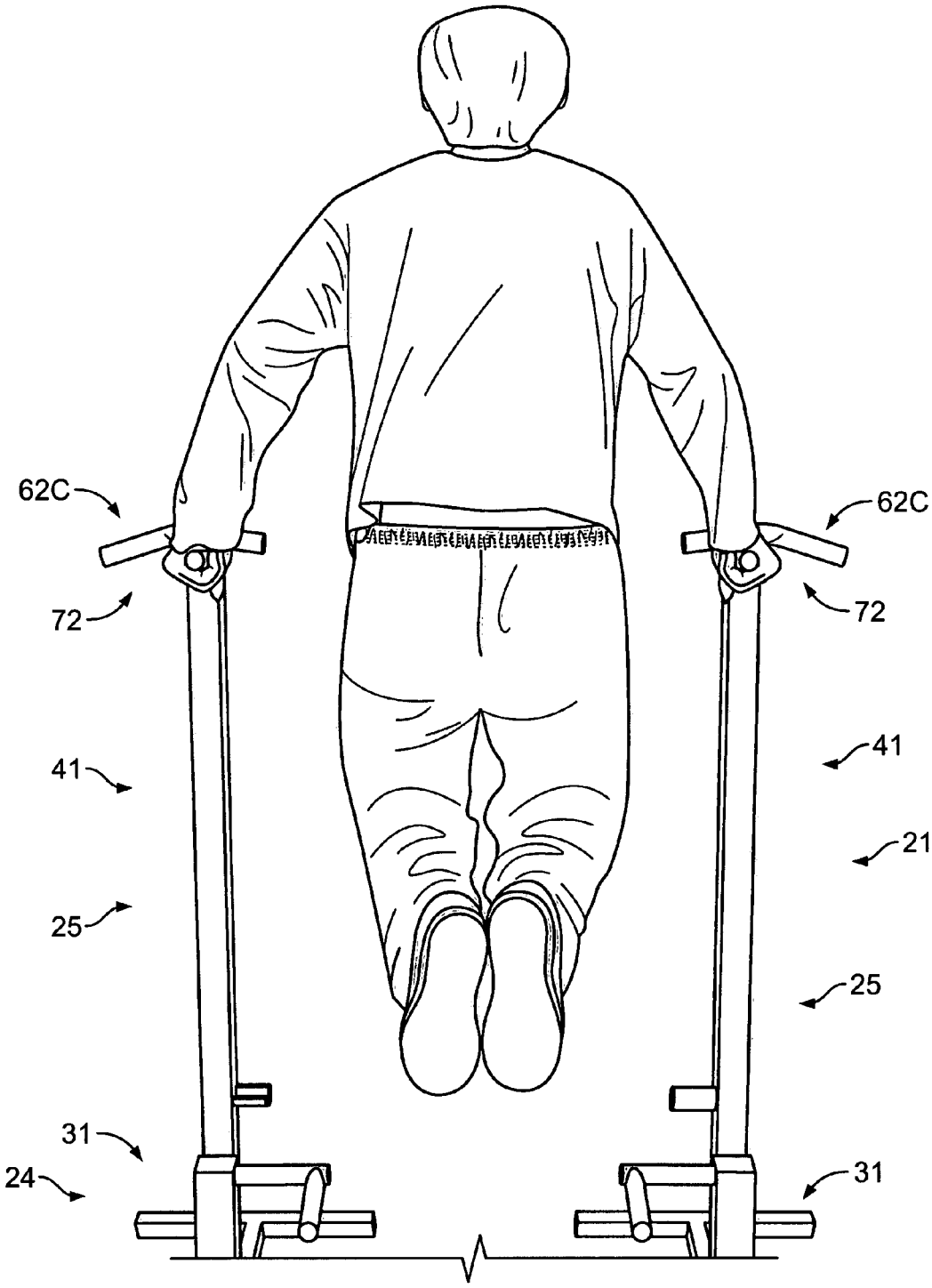
FIG. 5D shows the embodiment of the exercise system with handle collars illustrated in FIG. 5A through 5C in use.

To the collars 61, a variety of exercise handles 71 and other components may be attached. FIG. 5A through 5C show different views of an embodiment of a handle collar 62C. FIG. 5A and FIG. 5B show an exercise handle—termed "parallel handle" and designated "72"—affixed to the handle collar 62C such that the handle 72 extends along an axis 72A such that the handle 72 projects generally perpendicular to the front face 62F of the handle collar 62C and generally parallel to the plane "P" of the floor area 19. The embodiment of the handle collar 62C shown in FIG. 5C includes an additional exercise handle 71—termed "angled handle" and designated "73"—affixed to the handle collar 62L such that the handle 73 is affixed to a second face 62S of the handle collar 62C and at least a partial axis 72B along which the handle 73 extends at a downward sloping angle "B" relative to the floor plane "P". FIG. 5D shows the handle collar 62C in position and the parallel handles 72 of each support element 25 being used to conduct an exercise routine.

Figure 6:
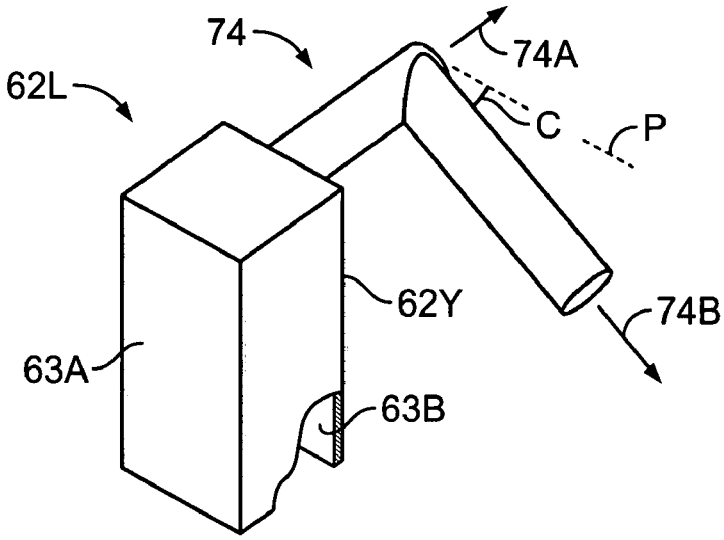
FIG. 6 is a perspective view of another embodiment of a handle.

FIG. 6 shows an embodiment of the lower collar 62L which includes an exercise handle 71—termed "inward handle" and designated "74"—affixed to a lower handle face 62Y of the lower collar 62L such that a first inward collar handle axis 74A along which the inward handle 74 extends is generally perpendicular to the lower handle face 62Y and a second inward collar handle axis 74B of the inward handle 74 is positioned generally in a plane that is parallel to the plane along which the lower handle face 62Y extends and at an angle "C" relative to the plane "P" of the floor.

Figure 7:
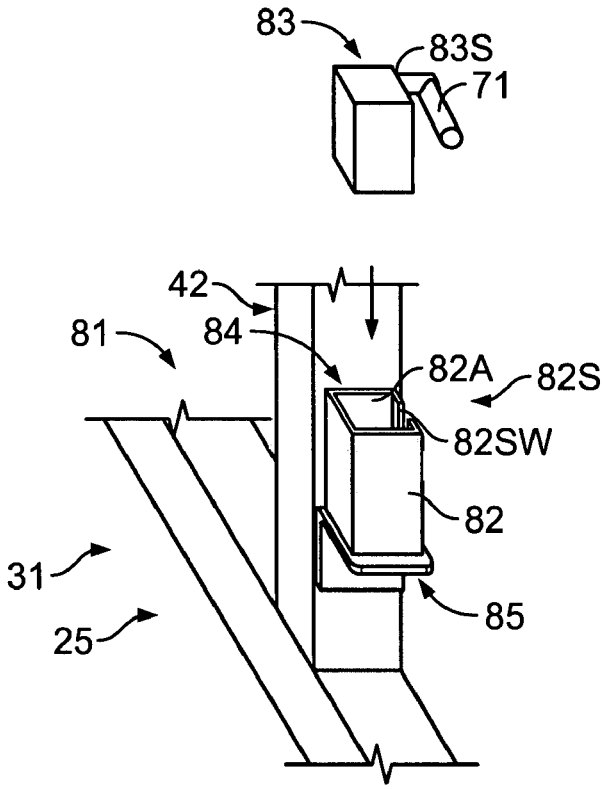
FIG. 7 is a partially exploded and partial perspective view of a handle sleeve.

FIG. 7 shows an embodiment of a support element 25 in which the vertical post 42 includes a sleeve 81. To the sleeve 81 an exercise handle 71 may be attached. In the illustrated embodiment, the sleeve 81 includes a sleeve wall 82 the interior surface 82A of which defines a sleeve aperture 84 sized and shaped and the inner side sleeve wall 82SW of which includes a slot 82S to receive a handle post 83 to a post side 83S of which an exercise handle 71 is affixed. The sleeve 81 may be supported by brace 85.

The two support elements 25 can be joined to form the apparatus 23 of the present invention preferably through the use of one or more stabilizers 91. The following describes the various embodiments of the stabilizer 91.

One preferred embodiment of the stabilizer 91 of the present system includes an upper stabilizer 92. An embodiment of the upper stabilizer 92 includes upper bar supports 93 on which a stabilizer bar 97 can be releasably be supported. One embodiment of the stabilizer 91 is shown in FIG. 1 and includes an embodiment of the stabilizer bar 97 having a bar outer surface 97A so that the bar 97 is shaped as an elongated cylinder. The illustrated embodiment of the bar 97 is sized such that each end 97E1 and 97E2 of the stabilizer bar 97 may be received in appropriately sized and shaped upper bar supports 98E1, 98E2. The embodiment of each support element 25 shown in FIG. 1 includes a handle collar 62 having an upper bar supports 98E1, 98E2 affixed to each inner side 63AI of the collar outer surface 63A. Among other embodiments, each of the upper bar supports 98E1, 98E2 may be formed from a bar support wall 99A that is shaped as a curved plane and has an upper support surface 99AS on which each end 97E1 and 97E2 of the cylindrically-shaped stabilizer bar 97 may be received and supported. The embodiment of upper bar supports 98E1, 98E2 shown in FIG. 1 includes one upper bar support 98E1 having a curved upper support surface 99A while the opposing upper bar support 98E2 includes a bar support wall 99A shaped as a cylinder 99AC with an bar aperture 99BA into which the end 97E2 of the bar 97 may be inserted and releasably retained. Certain of these elements are shown with respect to embodiment of the collar 61 shown in FIG. 2 and FIG. 5A-FIG. 5C. When it is time to disassemble the system 23, the bar 97, if in place, is lifted so that the end 97E1 disengages from contact with the upper support surface 99AS and the other end 97E2 is pulled from retention within the cylinder 99AC. With the upper stabilizer bar 92 in place, the two support elements 25 are joined to permit exercises to be stably conducted thereon. Such a system 21—in which a stabilizer bar is carried between the two support elements—not only acts to improve the stability of the entire exercise system but also allows an exerciser to do, for example, exercises—such as pull ups—that do not require additional exercise appliances but also those exercises that do require such appliances such as gravity boots, rings, etc.

Another embodiment of the stabilizer 91 of the present invention may include a lower stabilizer 93. One preferred embodiment of the lower stabilizer includes a stabilizer bar 97 that is similar or identical bar to the bar 97 which may be used as the bar 97 with respect to the upper stabilizer 92. Such a "universal bar" is advantageous in that costs associated with designing and manufacturing separate bars is avoided. Also, with one type of bar possibly used in two applications, the time that may have to be spent during assembly to determine which bar goes where in the system 21 is avoided. The lower stabilizer 93 shown in FIG. 2 includes a bar 97 shaped as an elongated cylinder. The illustrated embodiment of the bar 97 is sized such that each end 97E1 and 97E2 of the stabilizer bar 97 may be received in lower bar supports 98L1, 98L2 appropriately sized and shaped to receive the bar ends 97E1, 97E2. One embodiment of the stabilizer 91 is shown in FIG. 2 and includes an embodiment of the stabilizer bar 97 having a bar outer surface 97A so that the bar 97 is shaped as an elongated cylinder. The illustrated embodiment of the bar 97 is sized such that each end 97E1 and 97E2 of the stabilizer bar 97 may be received in lower bar supports 98L1, 98L2 appropriately sized and shaped to receive the bar ends 97E1, 97E2. The embodiment of each support element 25 shown in FIG. 2 includes lower bar supports 98L1, 98L2 affixed to each inner side 43S1, 43S2 of the vertical post 43. As with the upper bar supports 98E1, 98E2, among other embodiments, each of the lower bar supports 98L1, 98L2 may be formed from a bar support wall 99L that is shaped as a curved plane and has an support surface 99LS on which each end 97E1 and 97E2 of the cylindrically-shaped stabilizer bar 97 may be received and supported. The embodiment of lower bar supports 98L1, 98L2 shown in FIG. 2 includes one lower bar support 98L1 having a curved upper support surface 99LA while the opposing lower bar support 98L2 includes a bar support wall 99L shaped as a cylinder 99LC with an bar aperture 99LBA into which the end 97E2 of the bar 97 may be inserted and releasably retained. When it is time to disassemble the system 23, the bar 97, if in place, is lifted so that the end 97E1 disengages from contact with the lower support surface 99LS and the other end 97E2 is pulled from retention within the cylinder 99LC. With the lower stabilizer bar 92 in place, the two support elements 25 are joined to permit exercises to be stably conducted thereon. The system 21 may include either an upper stabilizer 92 or a lower stabilizer 93 or both upper stabilizer 92 and lower stabilizer 93. As with the upper stabilizer 92, a system 21 having a lower stabilizer 93 has improved stability plus permits an exerciser to engage in a wide variety of exercises. For example, the exerciser could do push ups on the lower stabilizer 93 such that the person's body is raised above and at an angle relative to the floor on which the exercise system rests. The lower stabilizer 93 can also permit—if placed in a position relatively closer to the floor—the exerciser to engage the bar with the exerciser's feet and perform sit ups without the need for another person to hold the exerciser's feet in place.

Figure 8:
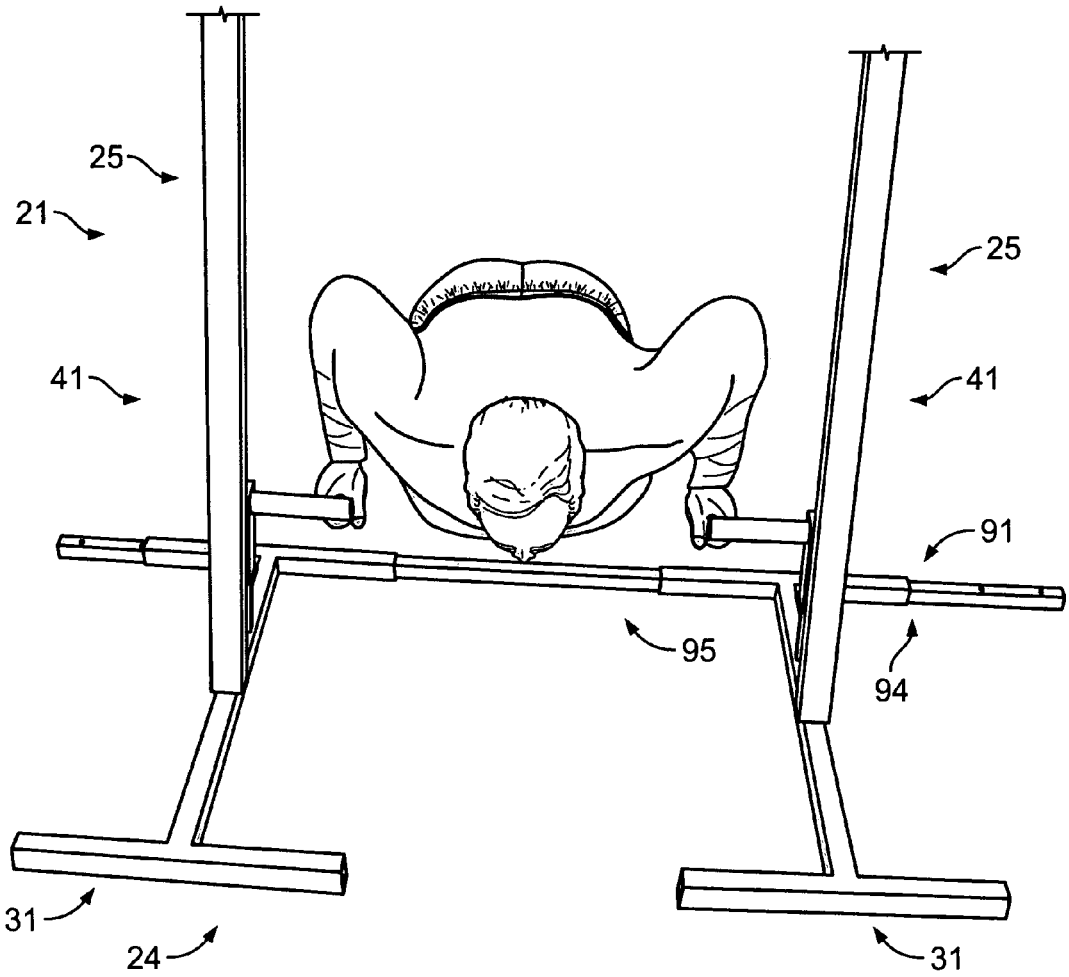
FIG. 8 is a perspective view of another embodiment of the exercise system in use.

An additional embodiment of the system 21 of the present invention may include a base stabilizer 94. An embodiment of the base stabilizer 94 includes a base bar 95 that is sized and shaped such that the bar 95 from either of the opposing base bar ends 95A, 95B of bar 95 may be inserted through one or both of the stabilizing rests 35A, 35B. The embodiment of the base bar 95 illustrated in FIG. 8 is a hollow tube having an angular cross section that is sized and shaped to pass through the hollow interior of the rests 35A, 35B.

With each support element 25 positioned generally side by side to each other, and the base components of the support base positioned generally adjacent to each other, the bar ends of the base bar may be received in opposing base receiving portions of the base components, thereby releasably uniting and stabilizing the separate support elements.

Figure 9A:
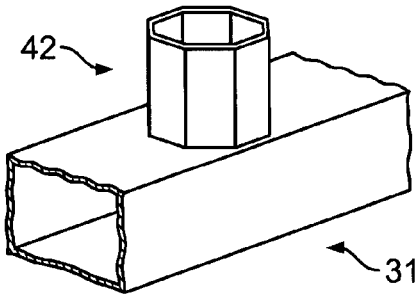
FIG. 9A is a perspective view of an additional embodiment of a post support.

Additionally, to provide additional adjustability of the system, and, more specifically, to allow the system base 24 to be more open in order to facilitate more access to and around the system 21 such as by a person in a wheelchair, the post support 42 may include a post support outer surface 42D having more than four sides (see FIG. 3A and FIG. 3C). A vertical post 43 having an inner surface 44B that is sized and shaped to fit over such a post support 42 allows the support base component 33 to be moved in additional positions. FIG. 9A shows an embodiment of a multi-sided post support 42.

Figure 9B:
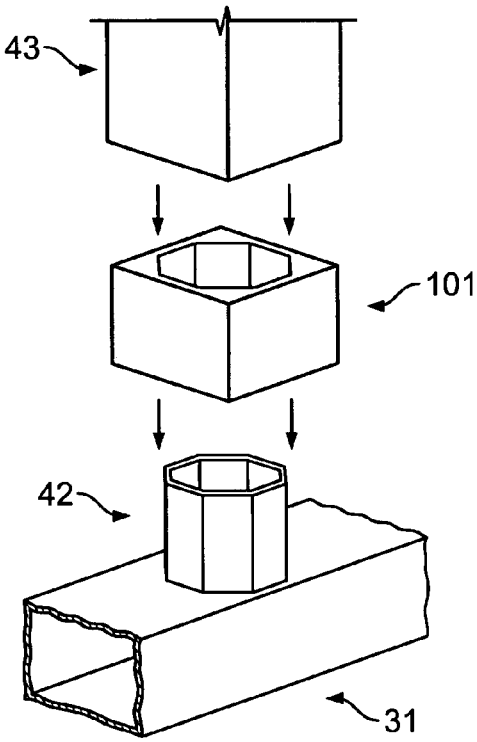
FIG. 9B is perspective view of the additional embodiment of the post support shown in FIG. 9A in use with other components of the exercise system.

An additional embodiment of the support element 25 may include a translation element 101 by which a post support 42 having more than four sides can be used with a vertical post 43 having an inner surface 44B that has a different number of sides different from the number of sides of the post support 42. FIG. 9B shows a translation element 101 by which a six-sided post support 42 can be used with a vertical post 43 having an inner surface 44B having only four sides. Other components of the system may include such translation elements 101 to permit different shaped components to be used with each other.

Figure 9C:
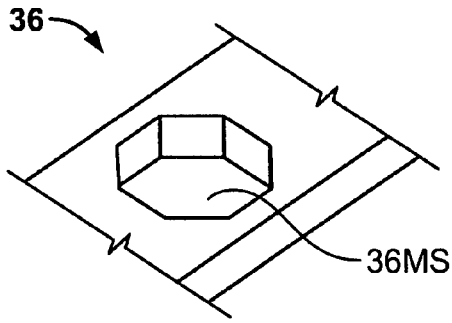
FIG. 9C is a partially cutaway perspective view of an additional embodiment of the present invention showing a multi-sided reception element.

FIG. 9C is a partially cutaway perspective view of an additional embodiment of a reception element 36MS that allows the support base component 33 to be moved in various positions. The reception element 36MS is configured to receive a vertical post 43 or a post support 42 onto which a vertical post 43 is positionable.

It will be understood that the embodiments of the present invention which have been described are illustrative of some of the applications of the principles of the present invention. Numerous modifications may be made by those skilled in the art without departing from the true spirit and scope of the invention.

What is claimed is:

1. A system for facilitating exercises comprising, a first support element including a first vertical component attachable to a first base, wherein said first vertical component further comprises a first vertical post and a first post extension that is in slideable engagement with said first vertical post to permit a first vertical dimension of said first vertical component to be generally adjustable;

a first collar including a first bar support and a first handle, wherein said first collar slideably inserts over said first post extension of said first vertical component of said first support element;

a second support element including a second vertical component attachable to a second base, wherein said second vertical component further comprising a second vertical post and a second post extension that is in slideable engagement with said second vertical post to permit a vertical dimension of said second vertical component to be generally adjustable;

a second collar including a second bar support and a second handle, wherein said second collar slideably inserts over said second post extension of said second vertical component of said second support element; and a stabilizer including a first end and a second end, wherein said first bar support receives said first end and said second bar support receives said second end thereby joining said first support element and said second support element, and a system base, wherein said system base includes said first base and said second base.

2. The system of claim 1, wherein said first base further comprises a first base section to which said first vertical post of said first vertical component is attachable.

3. The system of claim 1, wherein said second base further comprises a second base section to which said second vertical post of said second vertical component is attachable.

4. The system of claim 2, wherein said first base includes opposing ends onto each of which a first stabilizing rest is attached.

5. The system of claim 4, wherein said first stabilizing rest is aligned along a first rest axis and the first rest axis is positioned at an angle of less than 90° relative to a first base axis along which said first base is aligned.

6. The system of claim 2, wherein said first base section further includes a first post support onto which said first vertical post is slidably engaged.

7. The system of claim 2, wherein said first base section further includes a first reception element for receiving a first post support onto which said first vertical post is slidably engaged.

8. The system of claim 3, wherein said second base section includes opposing ends onto each of which a second stabilizing rest is attached.

9. The system of claim 8, wherein said second stabilizing rest is aligned along a second rest axis and the second rest axis is positioned at an angle of less than 90° relative to a second base axis along which said second base section is aligned.

10. The system of claim 3, wherein said second base section further includes a second post support onto which said second vertical post is slidably engaged.

11. The system of claim 3, wherein said second support base further includes a second reception element for receiving a second post support onto which said second vertical post is slidably engaged.

12. The system of claim 1, wherein said first support element further comprises a first sleeve.

13. The system of claim 12, wherein said first sleeve includes an exercise handle.

14. The system of claim 1, wherein said second support element further comprises a second sleeve.

15. The system of claim 14, wherein said second sleeve includes an exercise handle.

16. The system of claim 4, further comprising a first base stabilizer, wherein said first base stabilizer is inserted through said first stabilizing rest.

17. The system of claim 8, further comprising a second base stabilizer, wherein said second base stabilizer is inserted through said second stabilizing rest.

* * * * *